United States Patent [19]

McMillan

[11] 4,131,290

[45] Dec. 26, 1978

[54] SKI PROPULSION PACK

[76] Inventor: Joseph A. McMillan, P.O. Box 1331, Pagosa Springs, Colo. 81147

[21] Appl. No.: 842,479

[22] Filed: Oct. 17, 1977

[51] Int. Cl.[2] ..... A63C 11/00

[52] U.S. Cl. ..... 280/11.37 R; 180/1 G

[58] Field of Search ..... 280/11.37 R; 180/5 R, 180/1 R, 1 G; 128/137-139, 80 G; 272/79 R, 79 C; 214/1 S, 1 T, DIG. 13; 3/1.2

[56] References Cited

U.S. PATENT DOCUMENTS

| | | | |
|---|---|---|---|
| 440,684 | 11/1890 | Yagn | 128/80 G |
| 2,526,714 | 10/1950 | Varney | 180/1 G |
| 2,625,229 | 1/1953 | Voorhees | 180/1 G |
| 2,725,753 | 12/1955 | Haug | 180/1 G |
| 3,474,466 | 10/1969 | Collins | 3/1.2 |
| 3,645,348 | 2/1972 | Thompson | 180/1 G X |

*Primary Examiner*—Joseph F. Peters, Jr.
*Assistant Examiner*—Gene A. Church
*Attorney, Agent, or Firm*—Kyle W. Rost

[57] ABSTRACT

A back pack carries a self-contained motor and air pump, the air intake of the pump connected to a right and left hand linearly expandable and contractable hoses having sealed free ends attached to gloves. The pump draws air from the closed hose, causing the hose to linearly contract and thereby aids the skier in pulling himself past his hand-held ski poles. A pressure switch in one or both gloves activates a solenoid that opens a valve near the pump air intake, breaking the suction in the hoses and allowing the skier to reach forward, stretching the hose, and plant his poles for another pulling motion. A flow divider in association with the valve aids in relieving suction on the hose when the valve is open. A special interlocking coaxial plug connects the glove to the hose and wires from the plug to the solenoid are incorporated in the hose in a spiral pattern for spring-like flexture with the expanding and contracting hose.

9 Claims, 6 Drawing Figures

SKI PROPULSION PACK

BACKGROUND OF THE INVENTION

Field of the Invention — The invention relates generally to motor vehicles and more specifically to self-contained propulsion systems for the human body. A muscle assisting device for cross-country skiing is disclosed.

Description of the Prior Art — Ground travel across snow has always presented a problem with regard to the low friction between the snow surface and the foot of the traveller. The ski takes advantage of this low friction by allowing rapid controlled travel along downslopes, but requires that unnatural muscle movement be employed when long stretches of level ground or uphill terrain are encountered. Cross-country skiiers have developed many techniques for applying positive muscle power through the skis, often modifying the ski through special surfaces thereon to prevent backward sliding when the traveller is attempting to ascend a slope.

Mechanical aids for the skier have also been developed. Patent 3,645,348 to Thompson teaches a tractor tread device that can be used on the rear of a ski to propel the wearer up-hill. Patent 2,509,603 to Marin teaches a jet pack that can thrust the wearer in a desired direction. These inventions attempt to mechanize the sport of skiing, converting the ski into a minivehicle that retains the ability to coast down a hill. Yet, many persons seek and enjoy the activity of manually propelling themselves on skis, but could increase their mobility if given means to aid their muscles during long periods of exertion. The present invention provides a mechanically powered aid for the skier who wishes to decrease the fatigue of cross-country skiing while retaining the benefits of actively participating self-propulsion.

SUMMARY OF THE INVENTION

A muscle assisting device is worn by a cross-country skier or similar user to aid his arms in making pulling motions. The device includes a back pack having a self-contained motor thereon and an air pump operatively attached to the motor. The pump operates by drawing air through a linearly expandable and contractable hose connected to the pump air intake at one end and sealed at the opposite end, the suction created in the hose by the pump causing the hose to linearly contract. Suction release means such as a valve is attached to the hose near the pump air intake for venting outside air into the air intake and into the hose, allowing the hose to be linearly expanded by the user in anticipation of a subsequent pulling motion when the valve is later closed. The hose is provided with gripping means for engagement by the user's hands, for example gloves connected to the closed end of the hose. A switch may be located in a finger of such a glove for actuating the suction release means to either close or open the valve. A special locking coaxial plug may provide both electrical and mechanical connection between the glove and the hose, while wires leading from the switch to the suction release means may be incorporated in the hose structure so that the wire will not be locally stressed as the hose expands and contracts. In a preferred form of hose having a resilient spiral skeleton covered by a flexible skin, the wires may follow the spiral skeleton so that they flex in spring-like fashion.

The main object of the invention is to create a muscle aid to assist a skier or other user in making pulling motions with his arms, especially for pulling the human body forwardly on skis. For this purpose, a self-contained motor and pump assembly applies suction through a hose at selected times to linearly contract the hose, thereby assisting the user to draw back his hand to which the hose is connected, for example by a glove.

A further object is to create suction release means for the hose and pump that will aid the user in linearly stretching the hose when the user again extends his arm in anticipation of a further pulling motion. A solenoid actuated valve opens to admit atmospheric air into the hose and pump intake, breaking the suction within the hose. A flow divider is located in the hose opposite from the valve to aid in directing atmospheric air from the valve both toward the pump intake and in the opposite direction toward the contracted length of the hose.

An important object is to create an electrical connection between the solenoid actuated valve near the pump connected end of the hose and a switch near the opposite free end of the hose. The continued expansion and contraction of the hose may place undue stress on wires between the switch and solenoid. Thus, the wires are placed in the wall of the hose in a spiral pattern that allows the wires to flex in spring-like fashion for minimum stress on any limited portion of the wires. A locking coaxial plug may connect the wires to a glove on the free end of the hose.

DESCRIPTION OF THE PREFERRED EMBODIMENT

Figure 1:
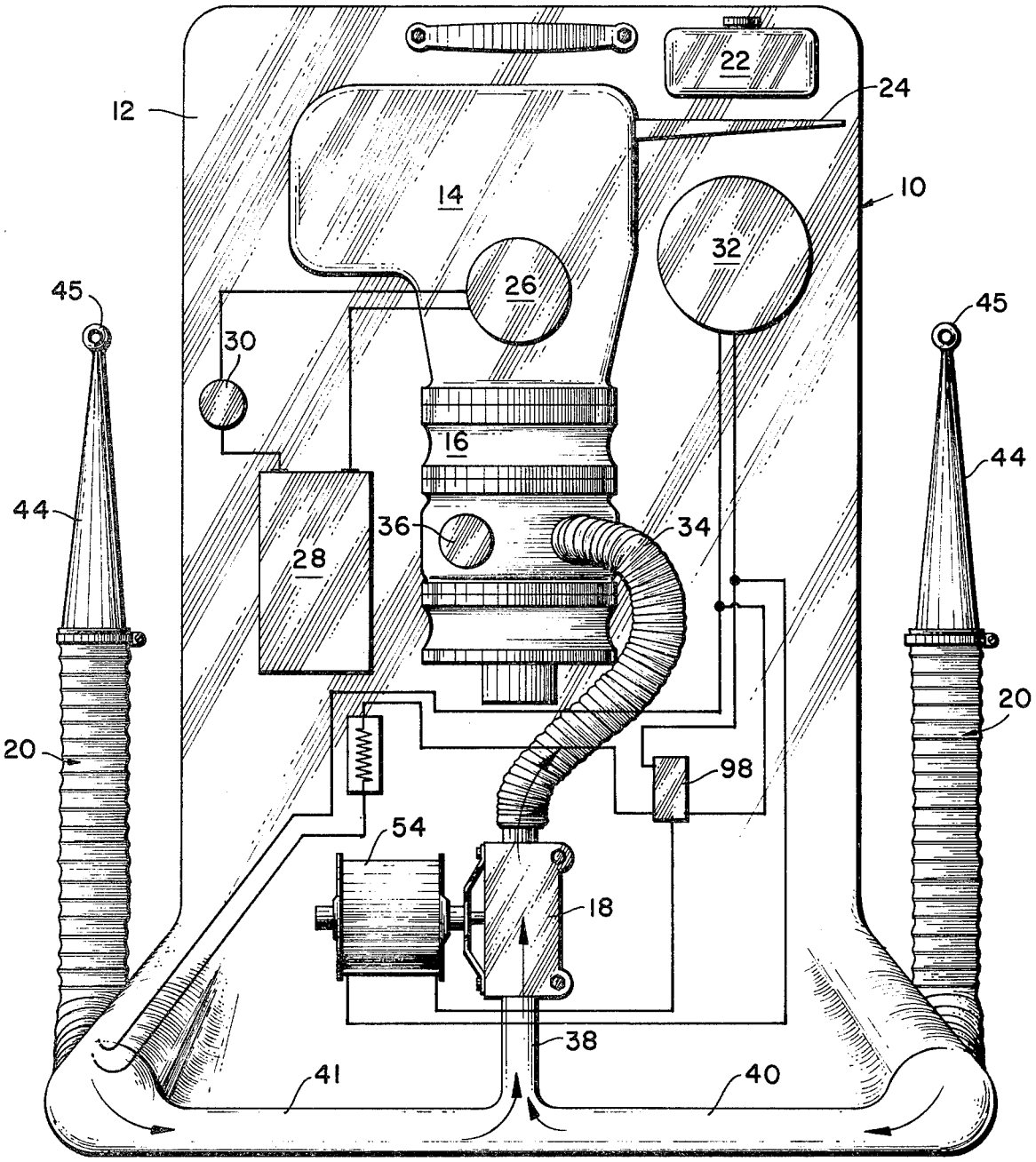
FIG. 1 is a rear elevational view of the invention.

The ski propulsion pack 10 is worn by the user as an accessory that may be completely independent of any specific ski or ski pole. As best shown in FIG. 1, the pack consists primarily of a unit worn on the user's back, with the various components mounted on a supporting device such as board 12 or other framework. The component parts include engine 14, air pump 16, suction release means 18, and linearly expandable and contractable hose 20.

Engine 14 may be any conventional light weight type such as a two or four cycle gasoline powered unit with attached fuel tank 22 and throttle control 24 extending laterally from the engine in easy reach of the user. If desired, the engine may be connected to a starter motor 26 activated by battery 28, for example a nickle-cadmium rechargeable battery, connected through starter button 30. A generator or alternator 32 may be powered by the engine to recharge the battery. In the interest of weight reduction, the starter, battery, and alternator could be eliminated and a simple magneto type engine will pull start utilized. Rubber bushings or other vibration dampers may be used in the mountings to board 12.

Air pump 16 may be directly coupled to the output shaft of the engine. The pump constantly draws air through hose 34 and discharges the air through exhaust 36. The speed of engine 14 controls the volume of air pumped, as regulated by throttle control 24.

Figure 4:
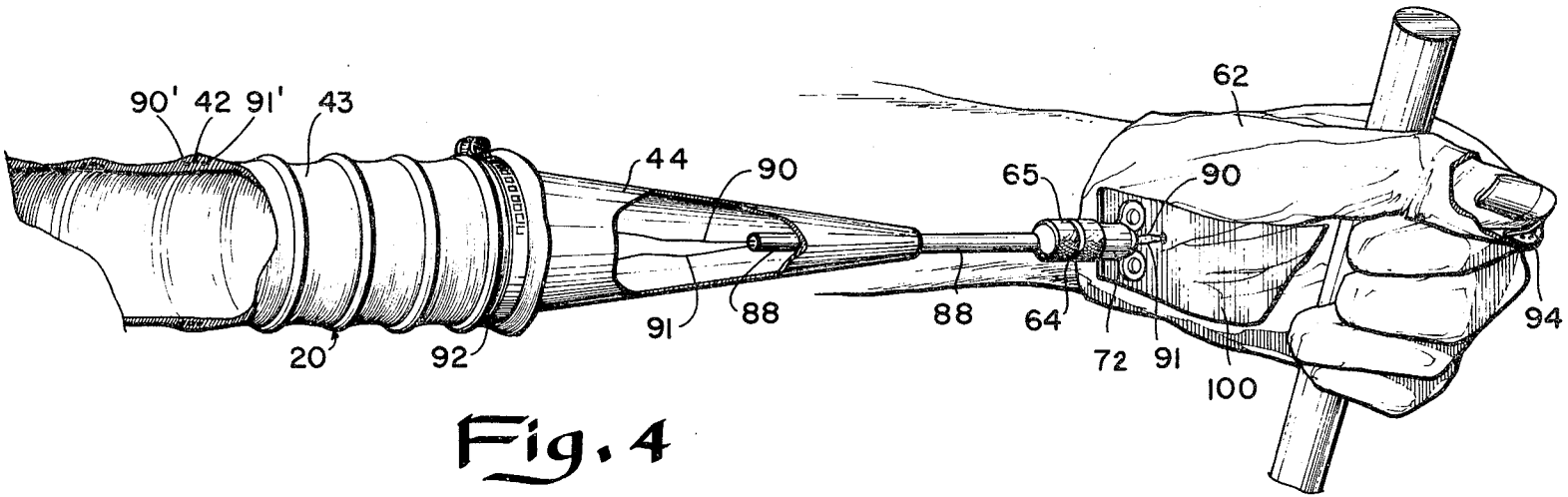
FIG. 4 is a perspective view in partial section of the free end of the hose means with attached coaxial plug and glove.

Hose 34 is connected through suction release means 18 to manifold 38 that branches into twin air ducts 40 and 41 extending respectively to the right and left of the user as the pack 10 is worn on his back. At the outward end of each duct 40, 41, the ducts bend forwardly and terminate in a connection to right and left hand linearly expandable hoses 20. The hose should have the ability to stretch for a substantial proportion of its fully contracted length, with a 7:1 stretch being desired. Such hose is well known and commerically available. As shown in FIG. 4, it often consists of a resilient spiral 42 forming the skeleton of the hose and a skin 43 of flexible fabric, rubber or plastic. At the outer extremity of hose 20 is sealing means such as thrust cone 44 carrying an attaching device, for example ring 45, at its tip.

Figure 2:
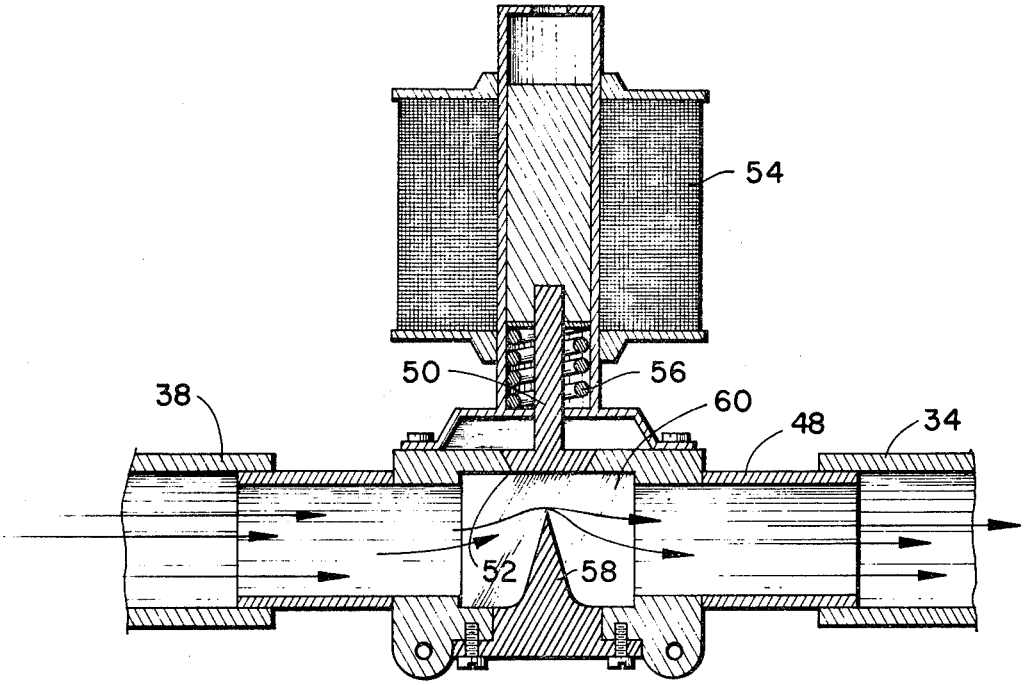
FIG. 2 is a cross-sectional view of the flow divider with the valve in closed position.
Figure 3:
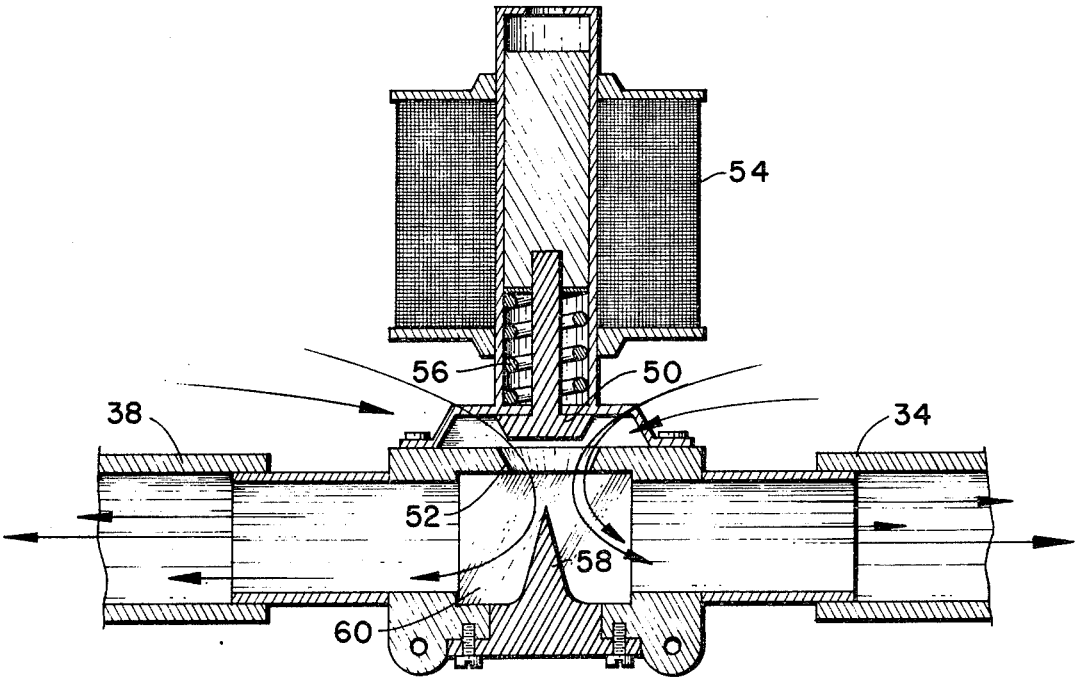
FIG. 3 is a cross-sectional view of the flow divider with the valve in open position.

As best shown in FIGS. 2 and 3, the suction release means includes tube 48 and interconnects hose 34 and manifold 38. Valve 50 in the wall of tube 48 seals valve port 52 when in closed position, shown in FIG. 2, or vents the interior of tube 48 to the atmosphere when in open position, as shown in FIG. 3. Solenoid 54 electrically controls the closing of valve 50, while spring 56 urges the valve to remain open if the solenoid is not activated. Flow divider 58 extends transversely in central chamber 60 of tube 48 and may be aligned with the center of port 52. Tube 48 may be square in interior cross section in chamber 60, and flow divider 58 may be wedge shaped and extend for approximately two-thirds to three-quarters of the distance into the chamber. When the valve is closed, pump 16 draws air from manifold 38 through tube 48, shown by the arrows of FIG. 2, but when valve 50 is open, pump 16 draws air through port 52, and flow divider 58 aids in directing some of the air into manifold 38, as shown by the arrows of FIG. 3. It should be understood that the flow divider is an aid in directing air to manifold 38 and hoses 20, but that there is not necessarily a positive force of such air. The flow divider may operate by directing the suction of pump 16 primarily through port 52, simply relieving suction on manifold 38.

Hoses 20 with thrust cones 44 thereon may be connected to any means engaged by or engageable with the hands of the user. As best shown in FIG. 4, the thrust cone may be connected to a special glove 62, or in the alternative cone 44 could be attached to a grip held in the user's hand or to the handle of a ski pole. If the embodiment of FIG. 1 where ring 45 on cone 44 is used, the ring may clip to a hook or shackle on glove 62, but in the preferred embodiment of FIGS. 4 and 5, the cone is attached to glove 62 by a special coaxial connecting plug 64. The male portion 65 of the plug has forwardly axially extending prong 66 and a plurality of radially extending lugs 68 at the base 69 thereof with axially rearwardly extending, radially aligned chisel shaped teeth 70 on the rear face of the lugs.

Female portion 72 conventionally engages prong 66 but also has locking means that engages lugs 68 and teeth 70. At the axially forward end of portion 72, which faces portion 65, is axially extending socket 74 that is circumferentially defined by circumferentially spaced, radially inwardly extending ears 75 having axially extending channels 76 therebetween shaped complimentarily to lugs 68. Socket 74 is terminated axially inwardly by radially extending face 77 of each ear 75 having notches 78 thereon shaped complimentarily to teeth 70. An inner chamber 79 adjoins face 77 and has an axial and radial dimension greater than the axial and radial dimension of base 69, creating sufficient room for the base to be rotated in chamber 79. Resilient means such as a spring 80 in chamber 79 applies pressure against base 69 when it is in the chamber. A conventional socket (not shown) for engaging prong 66 is located axially rearwardly of chamber 79 in portion 72.

Figure 5:
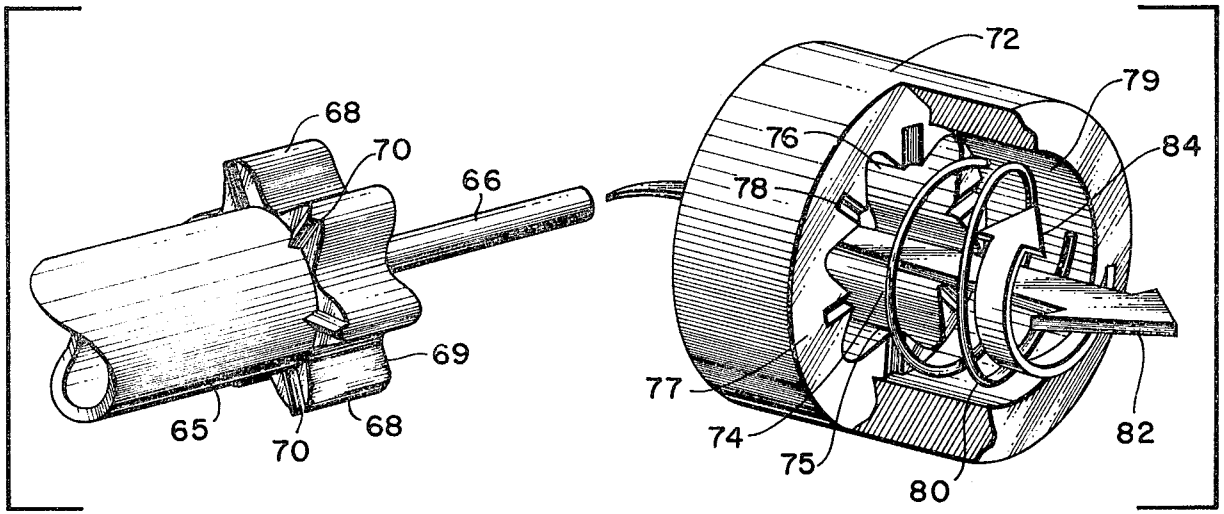
FIG. 5 is an isometric view of the locking portions of the coaxial plug, showing the operation thereof.

Plug 64 is connected by inserting portion 65 forwardly into portion 72, as shown by arrow 82, FIG. 5, until base 69 is fully past socket 74 and has entered chamber 79. Plug portion 65 is then twisted until teeth 70 are aligned with notches 80, illustrated by arrow 84. Spring 80 retains the teeth in the notches. Electrical connection between the plug halves is well known and forms no part of the present invention.

Portion 65 may be connected to metal sheathed coaxial cable 88 in a conventional manner. The cable may be molded into cone 44 or otherwise firmly attached thereto, and wires 90, 91 of cable 88 are routed through hose 20 to solenoid 54. Since hose 20 is repeatedly being linearly expanded and contracted, wires 90, 91 may be subjected to local stress and failure if loosely placed in hose 20 or if routed to solenoid 54 outside of hose 20. Therefore, it is preferred that the wires follow the spiral path of resilient member 42 so that they will flex in spring-like fashion with the hose, distributing the strain over the entire length of wire in hose 20. For this purpose, a special hose 20 best shown in FIG. 4 may have wires 90' and 91' molded or otherwise incorporated into the hose structure in the spiral path of member 42. The wires may replace member 42 if given sufficient strength to support walls of the hose against collapse under the suction of the pump. Electrical connection between wires 90, 91 within cone 44 and wires 90', 91' in the wall of hose 20 may be achieved at the end of hose 20 by routing a portion of either pair of wires through the cone or around clamp 92.

Figure 6:
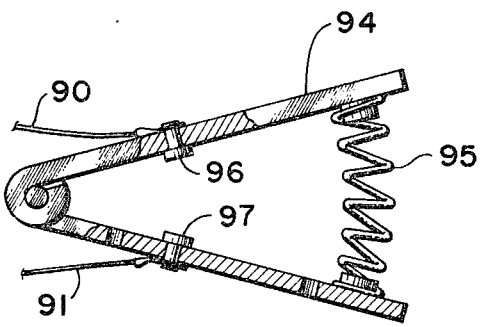
FIG. 6 is a side elevational view of a pressure switch in the glove of FIG. 4.

Portion 72 is conventionally connected to coaxial cable or to individual two wires 90, 91 that run through glove 62 to a switch 94 in the thumb of the glove. As shown in FIG. 6, the switch may be spring loaded in open position by spring 95, but contacts 96 and 97 are closed by slight pressure of the thumb against the index finger or other object.

Referring again to FIG. 1, wires 90, 91 emerge from one of the hoses 20 at duct 41 where the wires are connected to activate relay 98, which causes solenoid 54 to close valve 50 in response to closing of contacts 96, 97.

A pair of gloves 62 may be used with a switch 94 in each glove, allowing the solenoid to be activated by either hand, or only one glove 62 may have a switch and the other may be connected to a thrust one 44 by a similar or different connecting device. In FIG. 4, plug portion 72 is riveted to the glove and to a reinforced panel 100. An identical connection with a similar quick disconnect plug 64 may be used on the opposite hand, if desired.

In operation, the pack 10 is strapped to the user's back by a conventional harness. With engine 14 operating, gloves 62 on the user's hands, and thrust cones 44 connected to the gloves, the pack is ready for use. When the skier desires to propel himself along the ground, he reaches forward and plants both ski poles in the snow at an angle of approximately forty five degrees or less, relative to the ground. In reaching forward, the skier linearly stretches hoses 20, and in so doing draws air into the hoses through open valve 50. By closing switch 94, the skier closes relay 98 and activates solenoid 54, closing valve 50. Pump 16 is no longer able to draw air freely through port 52 and therefore draws air through manifold 38, ducts 40, 41, and hoses 20, with the hose being urged to linearly contract by the reduced pressure therein and thereby reduce its interior volume. As a result, rearward pulling force is applied through gloves 62, aiding the skier to propel himself.

The skier's arms are drawn backwardly toward pack 10, and the skier is accordingly pulled forwardly past his planted poles. At the conclusion of the stroke, or when the hoses 20 have contracted to their maximum degree, the skier releases pressure on switch 94, opening relay 98, which in turn deactivates solenoid 54 and opens valve 50. The pump now draws outside air and frees the hoses 20 to be easily linearly expanded as the skier reaches forward to replant his poles.

I claim:

1. A muscle assisting device for aiding the arms of a user in making pulling motions, comprising:

(a) an air pump having an air intake;

(b) linearly expandable and contractable hose means having an end connected to said air intake and an opposite closed end;

(c) suction release means having a first position venting said air intake and hose means to the atmosphere and a second position sealing the air intake and hose means against entrance of outside air;

(d) switch means for selectively moving said suction release means between first and second positions;

(e) attaching means for engaging the closed end of said hose means with the arms of the user; and (f) motor means connected to said pump for providing power thereto, the pump and motor means being carrier by the user.

2. The device of claim 1, wherein said suction release means comprises:

(a) a conduit having a chamber therein between said pump air intake and said hose means;

(b) a two position valve at one side of the conduit having first and second positions corresponding to said first and second positions of the suction release means;

(c) a flow divider within the conduit and opposite from the two position valve for assisting atmospheric air in entering the hose means in the direction of said closed end thereof while the pump draws atmospheric air through the valve in said first position.

3. The device of claim 2, wherein said flow divider comprises a wedge shaped air foil having the narrow edge thereof directied toward said two position valve and transversely aligned with the direction of air flow in said chamber when the valve is in said second position.

4. The device of claim 2, wherein said suction release means further comprises an electrically operated solenoid for moving said valve into said second position; and resilient means for opposing the action of the solenoid and loading the valve toward said first position.

5. The device of claim 1, wherein said attaching means comprises:

(a) grip means for engaging the hand of the user;

(b) a coaxial plug assembly having mating halves, one of which is attached to the closed end of said hose means and the other of which is attached to said grip means;

(c) a first of said halves being the male portion having a base, the base comprising a plurality of radially extending, circumferentially spaced lugs of predetermined maximum axial dimension, each lug having a radially aligned tooth extending rearwardly on the face thereof opposite from said prong;

(d) a second of said halves being the female portion having an axial socket formed therein, the axially forward end of the socket circumferentially defined by radially inwardly extending ears forming radially outwardly extending channels therebetween shaped to allow passage of said lugs, each ear terminating in an axially inward face having a notch therein shaped to receive one of said teeth, the female portion having an inner chamber of greater radial and axial dimension than said lugs for allowing the lugs to be inserted into the inner chamber and rotated therein to being the teeth into mating relation with the notches; and (e) resilient means in said interior chamber for urging the lugs of the male portion against the ears of the female portion when the teeth and notches are in mating relation.

6. The device of claim 5, wherein said switch means is a pressure switch connected to said grip means, conductive wires electrically connect the switch to the half of the coaxial plug assembly attached to the grip means, and conductive wires electrically connect the half of the plug assembly attached to the closed end of the hose to the suction release means, the plug assembly both mechanically and electrically joining the grip means and hose means.

7. The device of claim 5, wherein said grip means is a glove and said switch means is a pressure switch located in a finger of said glove and electrically connected to said coaxial plug assembly, and said coaxial plug assembly is electrically connected to the suction release means.

8. The device of claim 1, wherein said switch means is carried by said attaching means, and said hose means is the kind having a spiral of resilient material covered with a flexible skin allowing the sprial to axially expand and contract, wherein the switch means is electrically connected to the suction release means by conductive wires joined to the flexible skin of the hose means and following a spiral path parallel to the spiral of resilient material.

9. The device of claim 1, wherein said hose means comprises conical sealing members closing the closed end of the hose.

* * * * *